United States Patent [19]

Schwartz et al.

[11] Patent Number: 4,601,598

[45] Date of Patent: Jul. 22, 1986

[54] FINGER GRIPPING DEVICE

[76] Inventors: Allan E. Schwartz, 3 Bristol Pl., Yonkers, N.Y. 10710; Richard E. Frenkel, 33 Park Rd., Scarsdale, N.Y. 10583

[21] Appl. No.: 609,230

[22] Filed: May 11, 1984

Related U.S. Application Data

[63] Continuation-in-part of Ser. No. 527,019, Aug. 29, 1983, abandoned, which is a continuation-in-part of Ser. No. 367,379, Apr. 12, 1982, abandoned.

[51] Int. Cl.[4] ..... B43K 23/00

[52] U.S. Cl. ..... 401/6; 401/88; 401/91; 24/530

[58] Field of Search ..... 401/6, 88, 91, 8; D19/48, 50; 40/334; 24/530

[56] References Cited

U.S. PATENT DOCUMENTS

| | | | |
|---|---|---|---|
| 1,291,972 | 1/1919 | McGuigan . | |
| 1,807,415 | 5/1931 | LaFrance | 401/6 |
| 2,173,451 | 9/1939 | Lorber | 401/6 |
| 2,180,560 | 11/1939 | Stempel | 401/88 |
| 2,236,194 | 3/1941 | Lorber . | |
| 2,866,440 | 12/1958 | Green | 401/8 X |
| 2,870,740 | 1/1959 | Vogt | 401/88 X |
| 4,035,089 | 7/1977 | Schwartz et al. . | |
| 4,167,347 | 9/1979 | Hoyle | 401/88 |

FOREIGN PATENT DOCUMENTS

| | | | |
|---|---|---|---|
| 2655532 | 6/1978 | Fed. Rep. of Germany | 401/6 |

*Primary Examiner*—Steven A. Bratlie
*Attorney, Agent, or Firm*—Arthur Dresner

[57] ABSTRACT

A finger gripping device used as a removable attachment to a writing implement is formed as a one piece cylindrical body member made of flexible material. The body has an internal bore of uniform diameter so that it may be slid onto a writing implement. A plurality of circumferential ribs are axially spaced along the outside surface of the cylindrical body. The ribs are formed by closely spaced peaks and valleys.

5 Claims, 10 Drawing Figures

FIG. 4
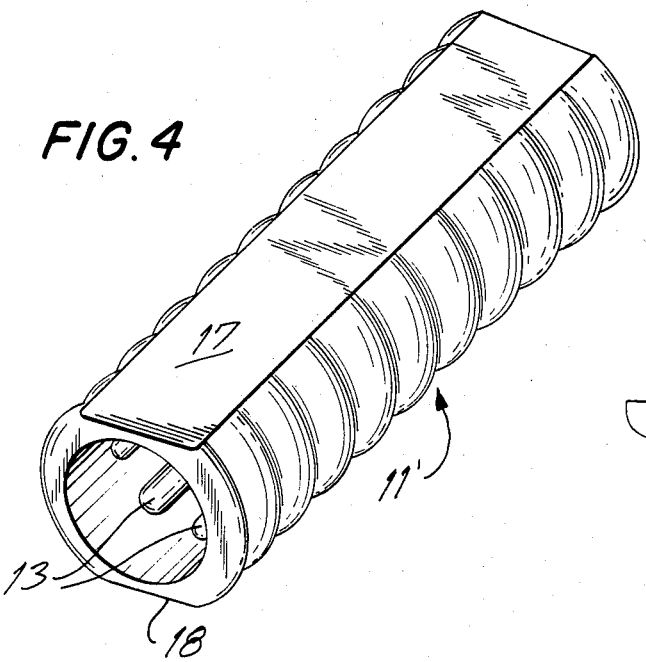
FIG. 8
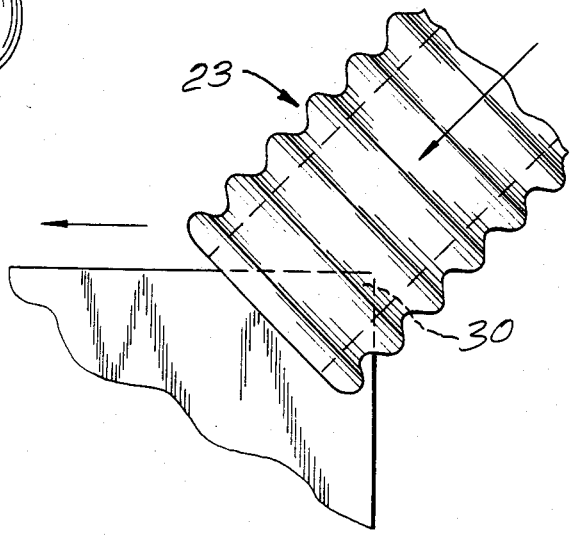
FIG. 9
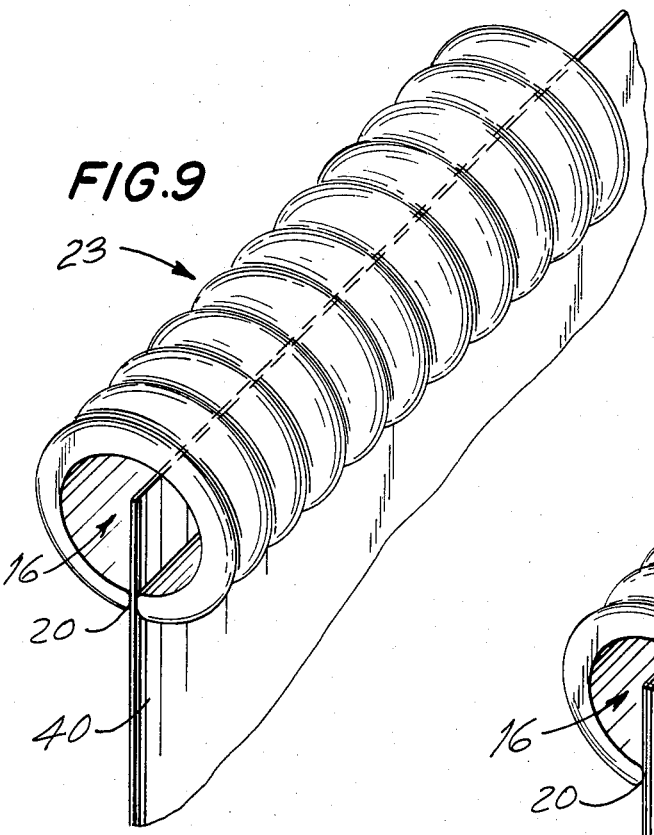
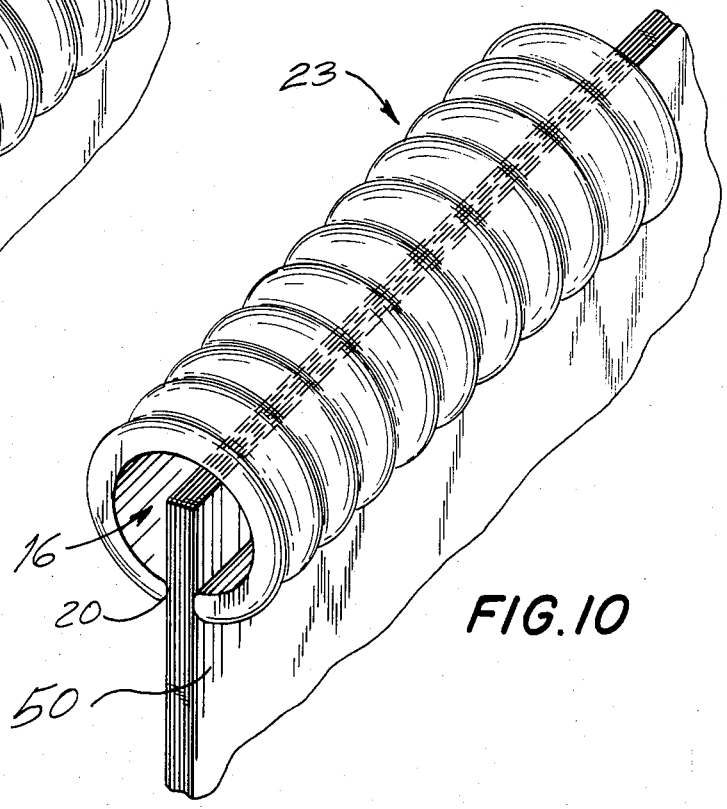
FIG. 10

FINGER GRIPPING DEVICE

BACKGROUND OF THE INVENTION

The present invention relates generally to gripping devices and more particularly to a device which may be used as a finger grip when slid on to a pen or pencil and in another form which may be used as a device for gripping papers together, i.e. in the form of a paper clip.

A variety of devices are known in the prior art for use as pen or pencil holder attachments. Prior U.S. Pat. Nos. 1,291,972 and 2,236,194 illustrate examples of such pencil holder attachment devices. These prior attempts at providing a comfortable finger grip surface for the user of a pen or pencil have not been able to provide to the user the desired degree of comfort and surface structure which would avoid writer's cramp or fatigue.

Prior U.S. Pat. No. 4,035,089 illustrates a writing implement which is provided with a mechanism for varying the diameter of the finger grip area. In this prior patent, the grip area, which is intended for expansion, includes a plurality of compressible O-ring elements which are supported on a cylindrical body section, and which are spaced by spacer elements. In this prior patent the O-ring structure is an attempt to provide the desired comfort that would alleviate writer's fatigue. The mechanism of prior U.S. Pat. No. 4,035,089 is however complex and costly to manufacture.

It is accordingly a principal object of the present invention to provide improvements of the finger grip illustrated in prior U.S. Pat. No. 4,035,089.

It is a more specific object of the present invention to provide a finger grip in a hand-held and finger supported instrument, which is simple in design, avoiding the use of large numbers of parts such as spacer elements, and both attractive and comfortable for use.

Another object of the present invention is to provide a form of the finger grip which may be used as a paper clip device.

The above objects, features and advantages, along with other objects, features and advantages of the present invention will become more apparent from the detailed description of the invention in conjunction with the accompanying drawings to be described more fully hereinafter.

SUMMARY OF THE INVENTION

The foregoing objects are generally accomplished by providing a finger gripping device for use as a removable attachment to a writing implement formed by a one-piece cylindrical body member made of flexible material. The body member has an internal bore of uniform diameter so that it may be slid onto a writing implement. A plurality of circumferential ribs are axially spaced along the outside surface of the cylindrical body. The circumferential ribs are formed by closely spaced peaks and valleys.

BRIEF DESCRIPTION OF THE DRAWINGS

The foregoing and other features of the finger gripping device of the present invention are more fully described with reference to the following drawings, in which:

FIG. 4 is a perspective view illustrating another form of the finger-gripping device for use with a pen or pencil;

FIG. 8 is a plan view showing another form of the gripping device of the present invention when in use as a paper clip;

FIG. 9 is a perspective view of the gripping device when in use as a paper clip on a thin sheaf of paper; and FIG. 10 is perspective view similar to that of FIG. 9 illustrating the gripping device as a paper clip when used on a thick sheaf of paper.

DESCRIPTION OF THE INVENTION

Figure 1:
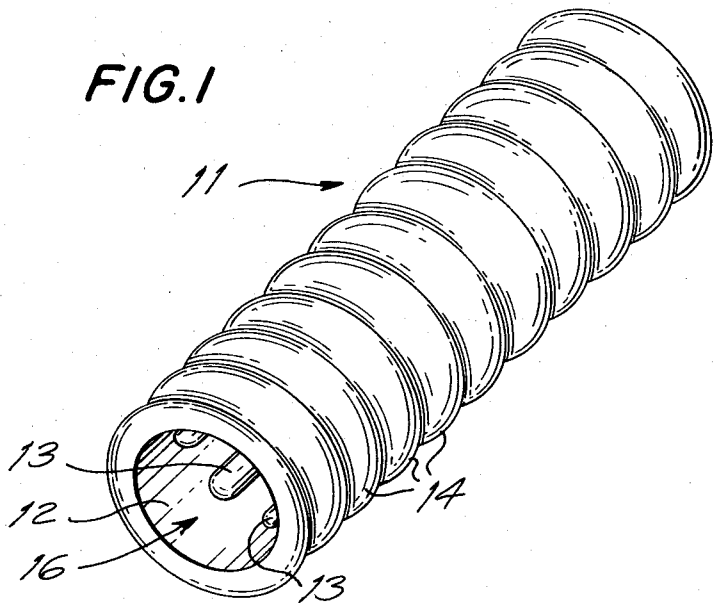
FIG. 1 is a perspective view showing one form of the finger grip device of the present invention for use with a pen or pencil.
Figure 6:
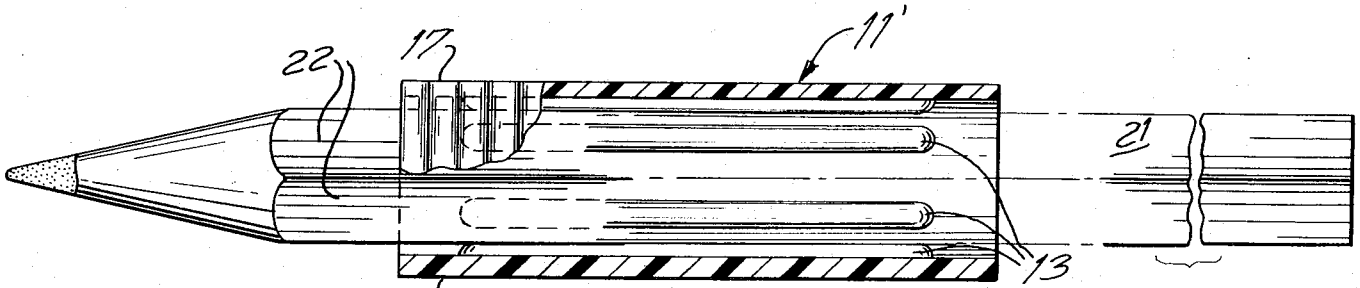
FIG. 6 is a sectional view taken along lines 6—6 of FIG. 5.
Figure 7:
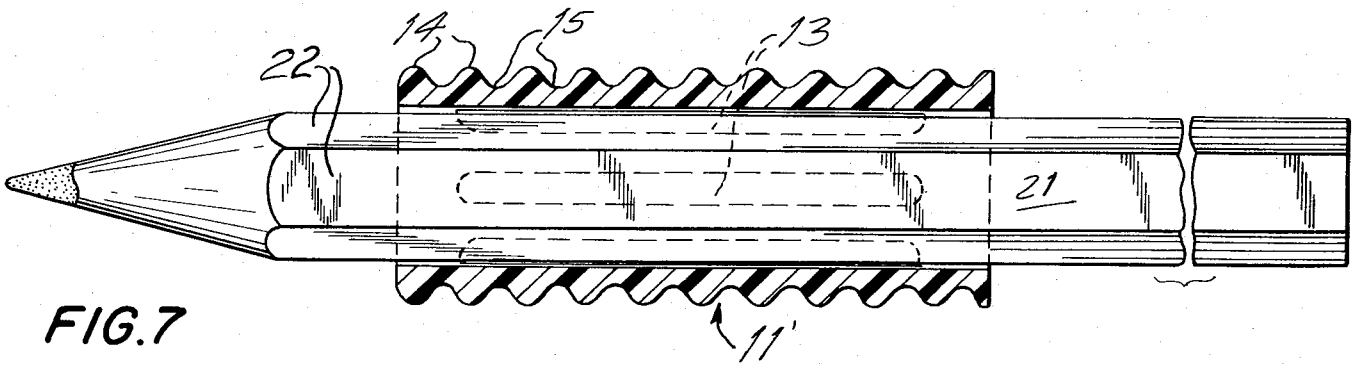
FIG. 7 is a section view taken along lines 7—7 of FIG. 5.
Figure 5:
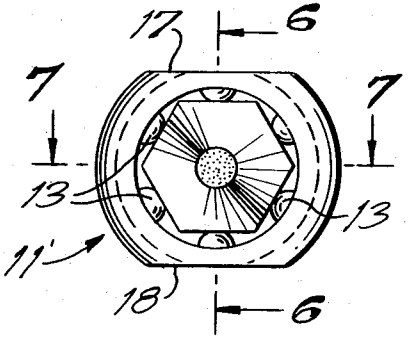
FIG. 5 is an end view showing the finger-gripping device of FIG. 4 in position on a typical pencil.

Referring now in more detail to the embodiment of the present invention as illustrated in FIG. 1 of the accompanying drawings, a finger grip 11 is illustrated as being formed of flexible material, such as rubber, flexible polymeric material, or other such material permitting flexing. The cylindrical body forming the grip 11 has a substantially smooth inner surface 12 with a plurality of longitudinally extending ribs 13. In the embodiment illustrated, six such longitudinal ribs 13 are equidistantly spaced about the inner surface 12 of the grip 11. The longitudinal ribs 13 are each of the same height and extend parallel to each other. These ribs 13 are used to facilitate the placememt of the grip 11 on a typical hexagonally shaped pen or pencil, such as pencil 21 shown in FIG. 3. The outer surface of grip 11 is formed as an undulating surface having peaks 14 and valleys 15 so as to produce a circumferential ribbed effect with the circumferential ribs being axially speced along the outer surface of the grip. In order to produce a comfortable gripping surface to avoid writer's cramp or fatigue, the peaks are preferably spaced approximately one eighth of an inch apart.

Figure 2:
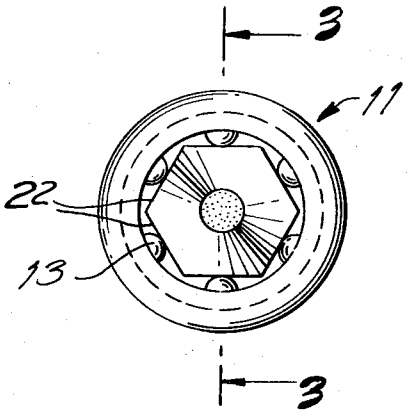
FIG. 2 is an end view of the finger grip device shown in FIG. 1 when placed in position on a typical pencil.
Figure 3:
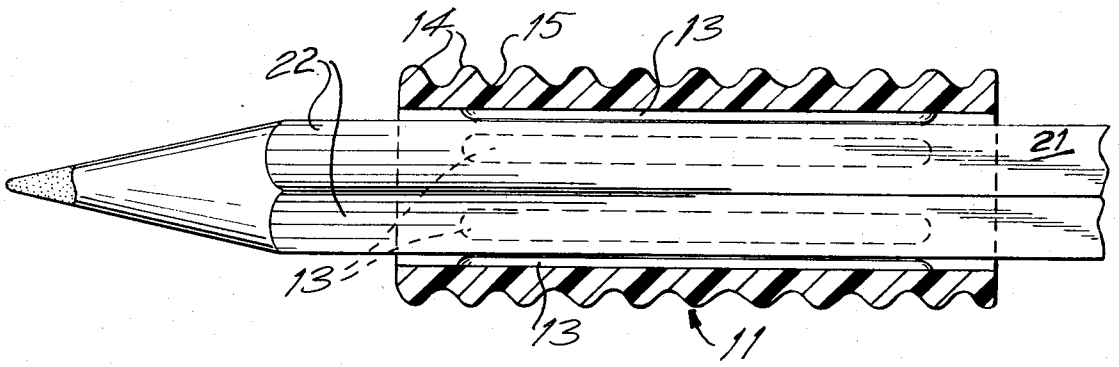
FIG. 3 is a sectional view taken along lines 3—3 of FIG. 2.

When in use, as illustrated in FIGS. 2 and 3, the grip 11 will be longitudinally slid on to the pencil 21 in such a manner so that ribs 13 will engage each of the six flat surfaces 22 of the pencil 21. In this manner the grip 11 is prevented from rotational movement on the pencil and thereby can be held firmly in place.

The cylindrical body of the grip 11 has a central bore 16 which is dimensioned so as to fit closely on and grip the pen or pencil on to which the grip 11 is placed. Since the material of the grip 11 is flexible it can be somewhat stretched so as to be pushed on to the pencil or pen.

In the embodiment illustrated, the central bore 16 is of a uniform diameter along the entire length of the grip so that it will fit with a uniform degree of snugness. The outside diameter of the peaks (or ribs) 14 is constant along the entire length of the grip 11 so that it is of uniform size.

Referring now to FIGS. 4 through 7, an alternate embodiment of the invention is illustrated. In this embodiment the grip 11' is provided with flat surfaces 17 and 18 which are diametrically opposed to each other. These flat surfaces offer the user alternate gripping surfaces and also serve the function of permitting imprinting various messages or data on the grip.

In other respects, the embodiment of the grip 11' is substantially similar to the grip 11 illustrated in FIGS. 1 through 3 and include the external ribbed surfaces formed by peaks 14 and valleys 15. Internal longitudinal ribs 13 are also provided to form the supporting contact surfaces on the internal surface of the grip.

FIGS. 8, 9 and 10 illustrate yet another embodiment of the present invention in which the cylindical body 23 has a longitudinal slit 20. The slit 20 permits the flexible cylindrical body of the grip to be used as a paper-gripping devices as a result of the resilient nature of the material by sliding the papers to be held through the slit 20 and into the internal bore portions 16 of the grip.

FIG. 8 illustrates how the grip may be used to secure the corner portion 30 of a stack of papers. FIG. 9 illustrates how the grip may be used to secure a relatively thin sheaf of papers 40 and FIG. 10 illustrates how the clip may be used to secure a thick sheaf of papers 50.

It will be appreciated from the foregoing that a very simple device has been provided to serve as a finger-gripping surface on a writing implement and which may also be used, when slightly modified, as a paper clip or paper-gripping device.

What is claimed is:

1. A finger-gripping device for use as a removal attachment to a writing implement comprising a one piece cylindrical body member made of flexible material, and said cylindrical body member having an internal bore of uniform diameter along the entire length of said cylindrical body member, a plurality of circumferential ribs axially spaced along the outside surface of said cylindrical body member forming a finger supporting surface when said cylindrical body member is carried on a writing implement, each said circumferential rib lying in a plane perpendicular to the axis of said cylindrical body member, each said plane being equally spaced between adjacent planes and parallel to each other plane, said ribs formed by closely spaced peaks and valleys interposed between said peaks, the outside diameter of each of said peaks of each of said circumferential ribs being the same so that said gripping device is of uniform size, and six raised longitudinally extending ribs oriented in parallel with each other and parallel to the longitudinal axis of said cylindrical body member being equally spaced apart along the inside surface of said cylindrical body member, each of said raised longitudinally extending ribs being of uniform height throughout its length, said height of each raised longitudinally extending rib being the same as the height of each other raised longitudinally extending rib.

2. The finger-gripping device according to claim 1 wherein said peaks forming said circumferential ribs are spaced approximately one eighth of an inch apart.

3. The finger-gripping device according to claim 2 further comprising a first flat surface extending the entire length of said body member on the outside surface thereof.

4. The finger-gripping device according to claim 3 further comprising a second flat surface extending the entire length of said body member on the outside surface thereof, said first and second flat surfaces lying in planes parallel to each other.

5. The finger-gripping device according to claim 1 further comprising a slit longitudinally extending along said body member parallel to the central axis thereof and through the full thickness of the wall of said cylindrical body member, the material of said body member being sufficently resilient so that said body member may function as a paper clip to hold objects within said slit.

* * * * *